US008677952B2

(12) United States Patent
Beninca et al.

(10) Patent No.: US 8,677,952 B2
(45) Date of Patent: Mar. 25, 2014

(54) COMPOUND DRIVE FOR THE SLEEVE VALVE OF AN ENGINE

(75) Inventors: Joseph Angelo Beninca, Reservoir (AU); Mark Frederick Jones, Frankston (AU)

(73) Assignee: Green Energy Gas Engines Pty. Ltd. (AU)

( * ) Notice: Subject to any disclaimer, the term of this patent is extended or adjusted under 35 U.S.C. 154(b) by 321 days.

(21) Appl. No.: 13/147,372

(22) PCT Filed: Feb. 22, 2010

(86) PCT No.: PCT/AU2010/000191

§ 371 (c)(1),
(2), (4) Date: Aug. 2, 2011

(87) PCT Pub. No.: WO2010/094078

PCT Pub. Date: Aug. 26, 2010

(65) Prior Publication Data

US 2011/0283962 A1 Nov. 24, 2011

(30) Foreign Application Priority Data

Feb. 20, 2009 (AU) ..... 2009900735

(51) Int. Cl.
*F02B 25/00* (2006.01)

(52) U.S. Cl.
USPC ..... 123/65 V; 123/188.5; 123/190.12; 123/65 VA

(58) Field of Classification Search
USPC ..... 123/65 VA, 65 VS, 80 C, 81 C, 188.5, 123/190.12
See application file for complete search history.

(56) References Cited

FOREIGN PATENT DOCUMENTS

| | | |
|---|---|---|
| GB | 7942 | 0/1912 |
| GB | 295013 | 3/1929 |
| GB | 511507 | 8/1939 |
| WO | WO 2007/057660 | 5/2007 |

*Primary Examiner* — Noah Kamen
(74) *Attorney, Agent, or Firm* — Galbreath Law Offices, P.C.; John A. Galbreath

(57) ABSTRACT

A drive train for the sleeve of a sleeve valve engine has a pair of drives imparting compound motion to the sleeve which gives improved port opening and closing. One drive uses a engine driven first gear to give eccentric motion to the sleeve by a cam and follower. The other drive uses an engine driven second gear to give a small simultaneous rotation to the sleeve by an eccentric pin during a split sleeve. One drive allows axial response without preventing rotational response from the other drive. The sleeve path allows tall narrow ports which allow the piston rings to be nearer the piston crown and this reduces emissions.

7 Claims, 10 Drawing Sheets

COMPOUND DRIVE FOR THE SLEEVE VALVE OF AN ENGINE

FIELD OF THE INVENTION

This invention concerns sleeve valve engines and particularly to the drive imparted to the sleeve valve itself.

BACKGROUND OF THE INVENTION

Sleeve valve engines display certain limitations, one of which is the shape of the port opening and closing path imposed by a single sleeve crank joined to the trailing end of the sleeve by a ball and socket. The path is elliptical in shape. It is preferable to place the topmost piston ring close to the piston crown to ensure low emissions.

If the stroke of the sleeve crank is made long enough to obtain sufficient sleeve aperture opening then the rotational motion necessitates wide port apertures. During the overlap period in the Otto cycle when both ports apertures are open together and the piston is near Top Dead Centre the piston rings or at least the top ring will cross the port apertures and will not be adequately supported. They tend to "fall in" causing excessive ring wear.

Modern engines need high compression ratios to achieve better engine efficiency and this means that the piston crown is closer to the cylinder head which reduces clearance volume. The end result is that the piston crown further protrudes into the aperture zone.

In our co-pending application for Patent No. 2008901933 we describe a sleeve valve construction wherein the sleeve has an inlet aperture and an outlet aperture and an internal coolant path between the apertures in the wall of the sleeve for conducting the heat of combustion away from the sleeve. This improvement is applicable to sleeves of that particular construction.

In U.S. Pat. No. 2,411,571 a sleeve valve engine with opposed cylinders has a sleeve valve drive which uses a pair of ring gears to rotate the sleeve for each of the cylinders. Axial movement of the sleeve is imparted by a rotating disc adjacent to the sleeves which projects into a helical groove in the end of the sleeve. The pitch and length of the groove is slight so as to cause sufficient reciprocation to rub away carbon deports which would otherwise collect in the sleeve ports. This is not effective for assisting with advantageous port shape.

SUMMARY OF THE INVENTION

The apparatus aspect of the invention provides a sleeve valve engine wherein the sleeve valve which opens and closes the ports is driven by a first sleeve drive which imparts reciprocatory motion to the sleeve while a second sleeve drive imparts partial rotation to the sleeve.

In the first drive, a block adjacent the sleeve describes an eccentric path in order to reciprocate the sleeve and the block engages a follower projecting from the sleeve which allows the sleeve to describe an arcuate path while reciprocating. The follower has a thrust face at the leading end and a like thrust face at the trailing end. The arc of movement corresponds to the sleeve rotation suffices to cover and uncover the ports in the cylinder head. The thrust faces may be mutually parallel and disposed transversely to the axis of reciprocation. The second drive comprises an axially disposed slide projecting from the sleeve with a substantially cylindrical surface interrupted by a gap, a pin which describes eccentric motion and projects into the gap and a head carried by the pin, the opposite ends of which are curved to contact the cylindrical surface, whereby the pin imparts arcuate motion to the sleeve while allowing the slide to reciprocate in response to the first drive.

The block may be eccentrically mounted on a first gear wheel rotating on an axis disposed at 90° to the cylinder axis.

Likewise the pin in the second drive may be eccentrically mounted on a second gear wheel rotating on the same or different axis also disposed at 90° to the cylinder axis and lying diametrically opposite the first gear wheel. While this 180° arrangement of the first and second gear wheels is convenient, the drives work equally well if the angle is smaller than 180°.

The first and second gear wheels may be part of a right angle drives from the half speed valve motion gears which are present in all valve engines which depend on the Otto cycle. Thus the first and second drives contribute to the sleeve motion simultaneously and together impose an elliptical path on the sleeve. The valve motion gears are connected for rotation in unison by a chain or toothed belt. The path is however modified over that known in the prior art and the improved elliptical path allows variation in port design. There may be multiple ports in the sleeve preferably up to seven.

BRIEF DESCRIPTION OF THE DRAWINGS

One embodiment of the invention is now described with reference to the accompanying drawings, in which.

DETAILED DESCRIPTION WITH RESPECT TO THE DRAWINGS

Figure 1:
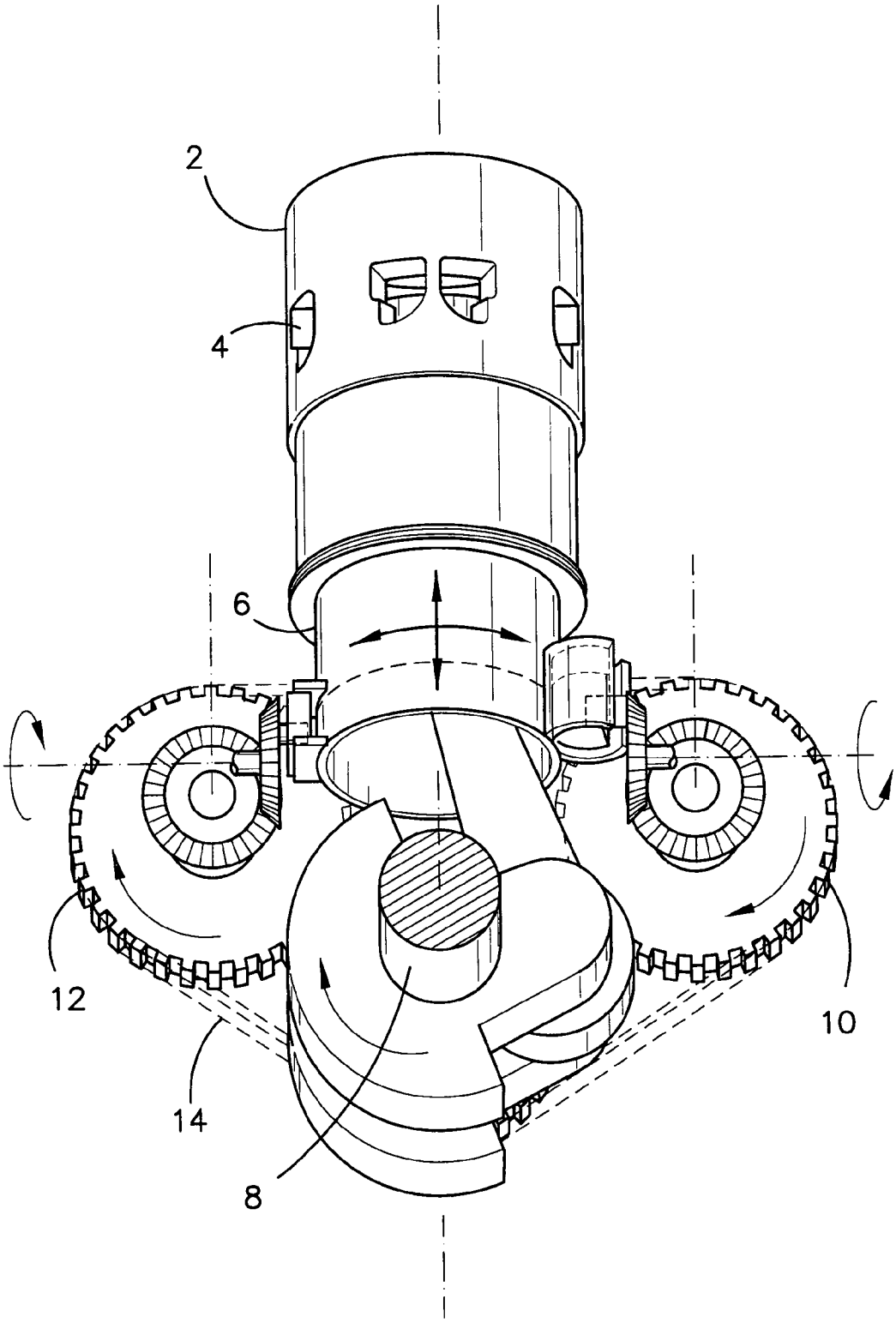
FIG. 1 is a diagrammatic perspective of the working parts.
Figure 2:
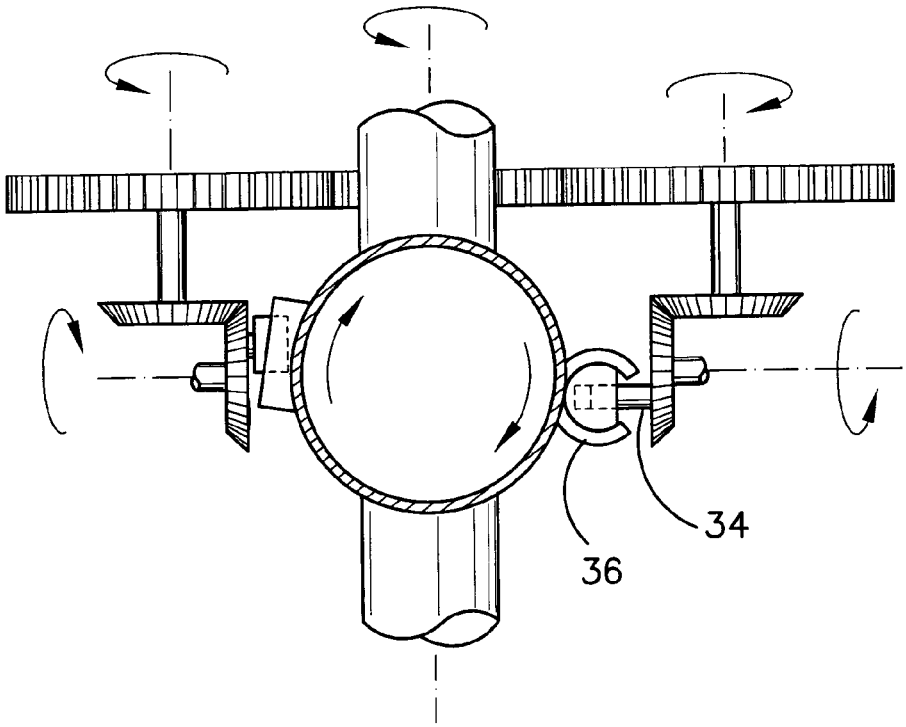
FIG. 2 is a diagrammatic plan of the working parts of FIG. 1 with sleeve rotation at 80° to the crankshaft.
Figure 3:
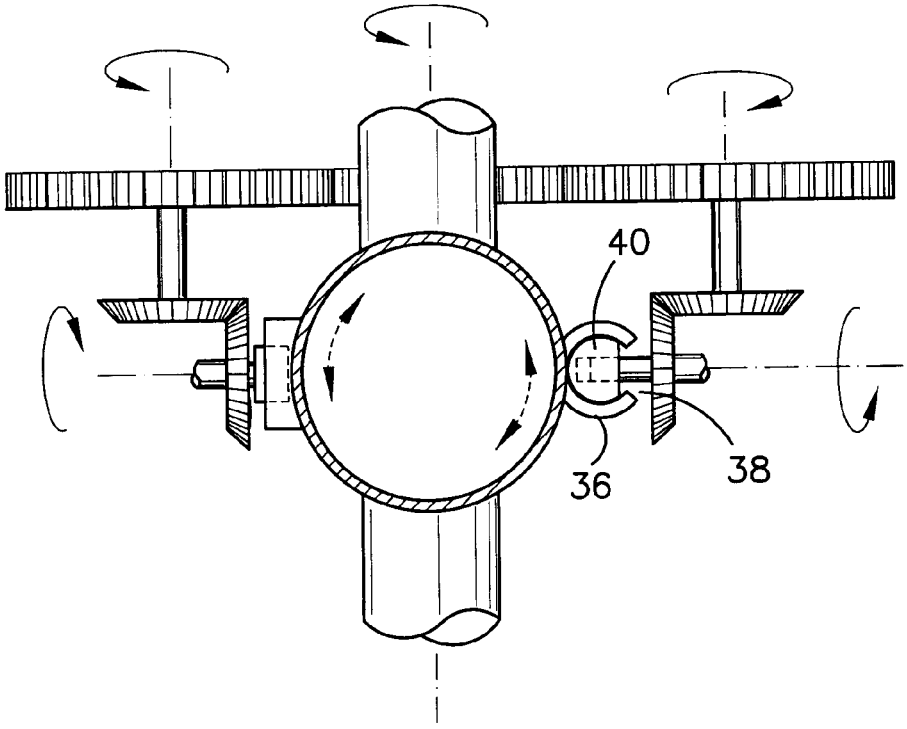
FIG. 3 is a diagrammatic plan of the working parts of FIG. 1 with sleeve rotation at 90° to the crankshaft.
Figure 4:
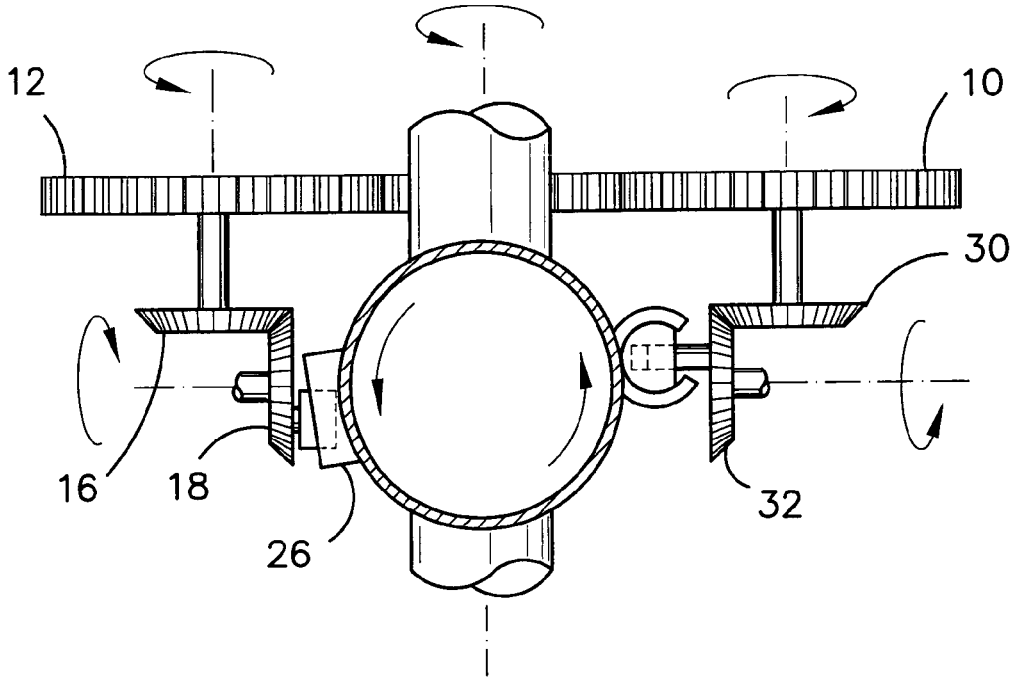
FIG. 4 is a diagrammatic plan of the working parts of FIG. 1 with sleeve rotation at 100° to the crankshaft.
Figure 5:
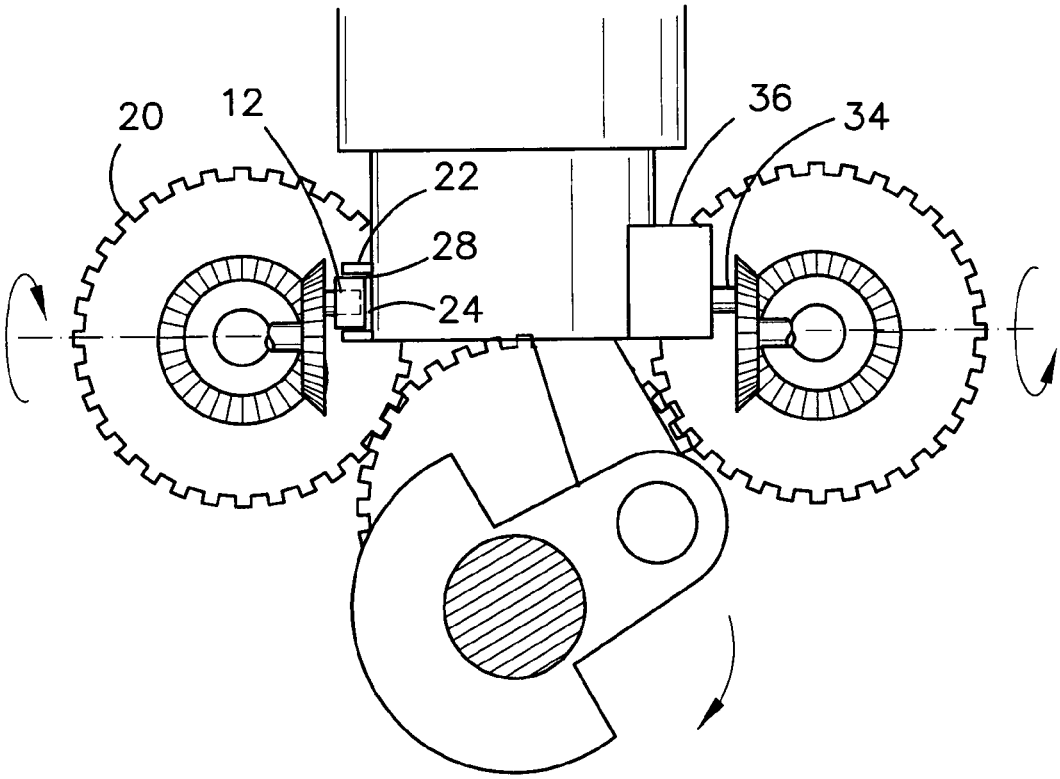
FIGS. 5, 6 and 7 are side views of the sleeve drives in FIGS. 2, 3 and 4.
Figure 6:
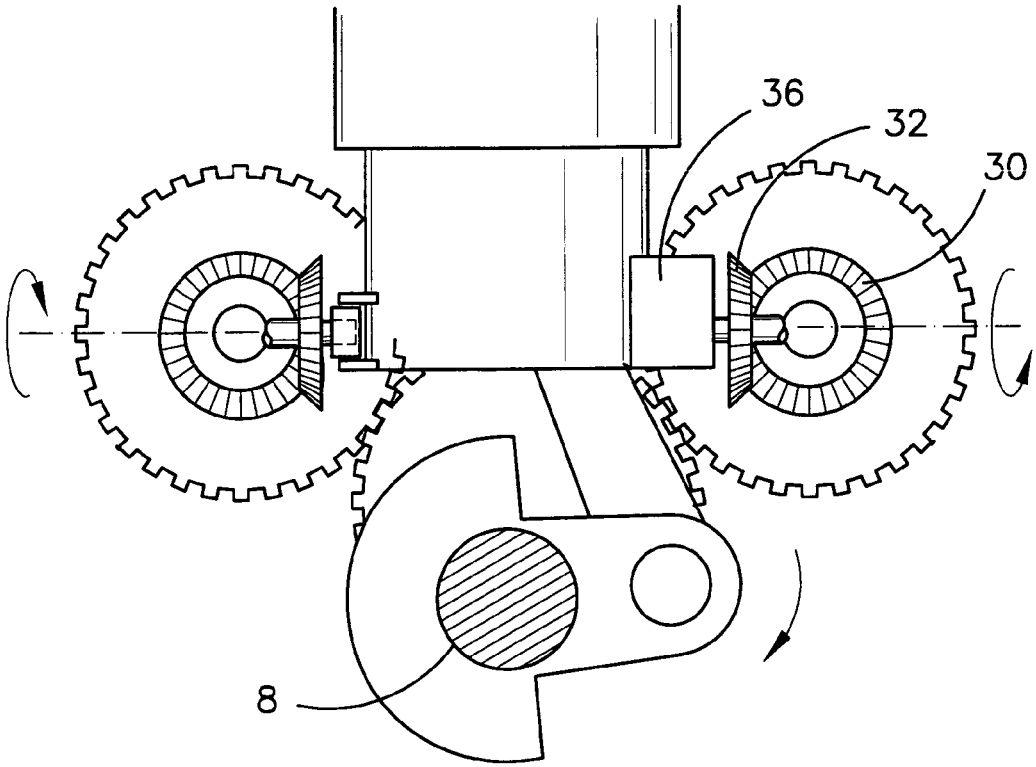
Figure 7:
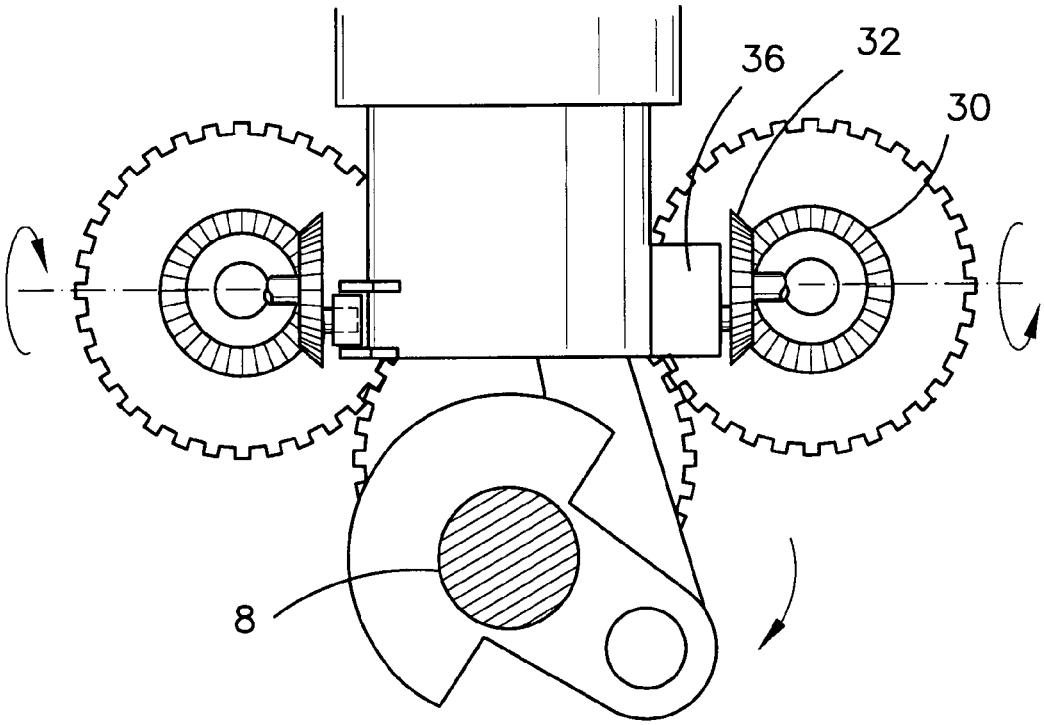

Referring now to FIGS. 1-8, the cylinder 2 has pairs of apertures 4 arranged around the circumference which register with ports in the cylinder block which connect with fuel/air supply (not shown) and exhaust ducts.

Sleeve valve 6 likewise has pairs of apertures which move in and out of register with the cylinder apertures and connect the cylinder to inlet and exhaust in accordance with the Otto cycle.

The lower end of the sleeve valve extends beyond the end of the cylinder by about 30 mm in order to accommodate the sleeve drive taken from crankshaft 8 by toothed wheels 10, 12 and a common toothed belt 14.

Wheel 12 rotates clockwise and drives bevel gear 16 and thereby bevel gear 18. Bevel gear 18 lies adjacent the moving sleeve valve and has an eccentric pin 20 which projects between parallel thrust faces 22, 24 of a follower 26 projecting from the outer surface of the sleeve valve. The metal faces are sufficiently long to remain in contact over 20° of sleeve valve rotation with a metal block 28 engaged by pin 20. Block 28 gives better area of contact with the thrust faces than the pin alone.

Wheel 10 rotates clockwise and drives bevel gear 30 and thereby bevel gear 32. Bevel gear 32 likewise lies adjacent the moving sleeve valve at 180° to bevel gear 18. Bevel gear 32 drives eccentric pin 34. Split cylindrical sleeve 36 is fixed to the outer surface of sleeve valve 6 diametrically opposite the follower 26. Eccentric pin 34 projects through a gap 38 in the split sleeve and engages rocker 40. Rocker 40 has curved end faces equidistant from the pin 34 which mate with the internal cylindrical surface of the sleeve 36.

Figure 8:
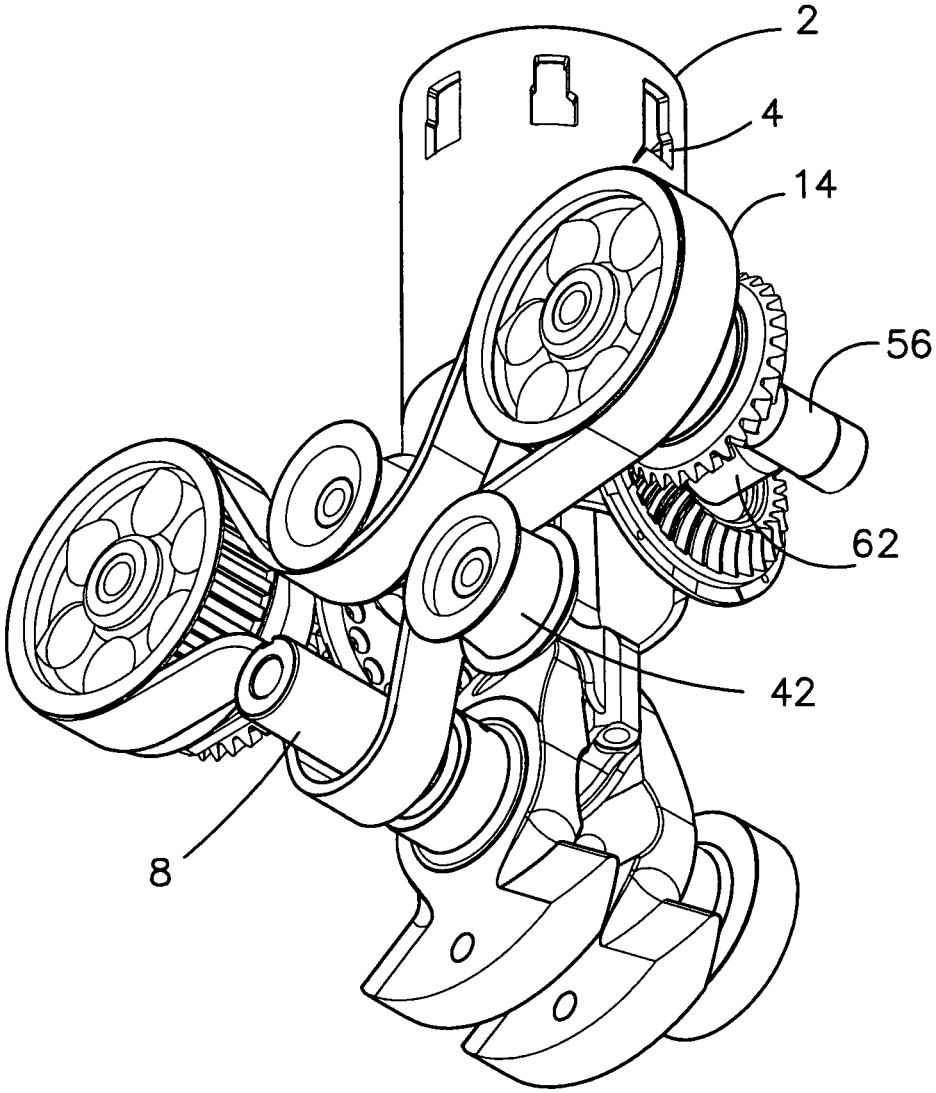
FIG. 8 is an underneath perspective of a variant showing toothed belt drive.

The bevel gears 18, 32 are co-linear and disposed at 90° to the crankshaft axis. A 10° rotation clockwise followed by a 10° reversal and 10° rotation anticlockwise is within the travel of the block 28 and the rocker 40. The follower 26 and split sleeve 36 add little to the mass of the sleeve valve but improve engine performance in that they permit separation of the sleeve motion into reciprocating and rotational components. Separation of these components into two drives permits variation in port design. In FIG. 8 the way in which the toothed belt 14 takes drive from the crankshaft is shown. Idler 42 allows belt adjustment.

Figure 9:
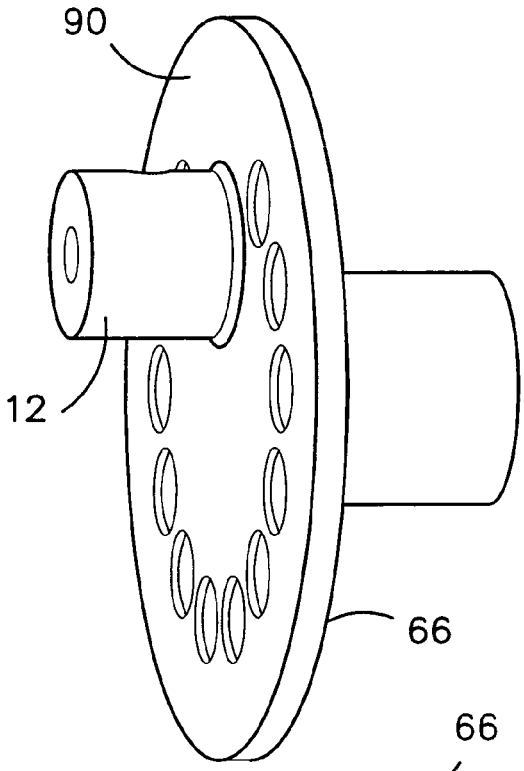
FIG. 9 is a perspective of the wheel which gives axial drive to the sleeve.
Figure 10:
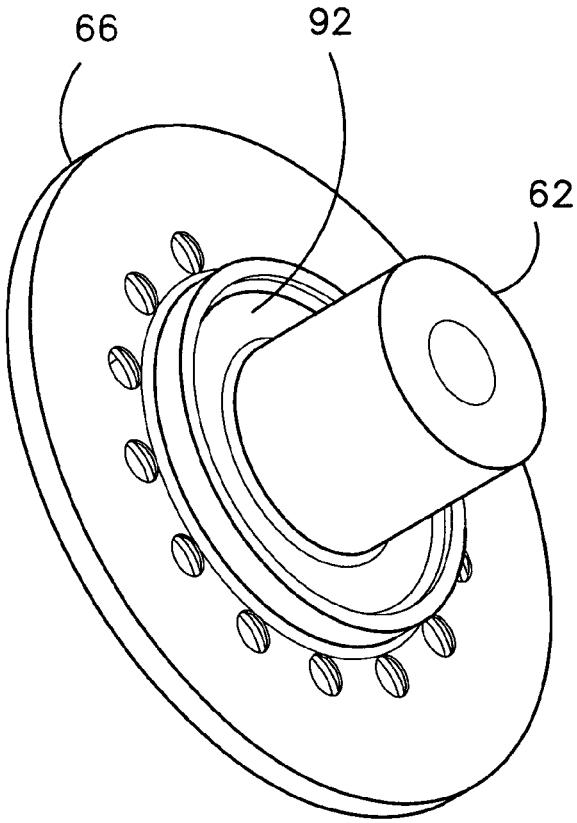
FIG. 10 is a view of the reverse face of the wheel shown in FIG. 9.
Figure 11:
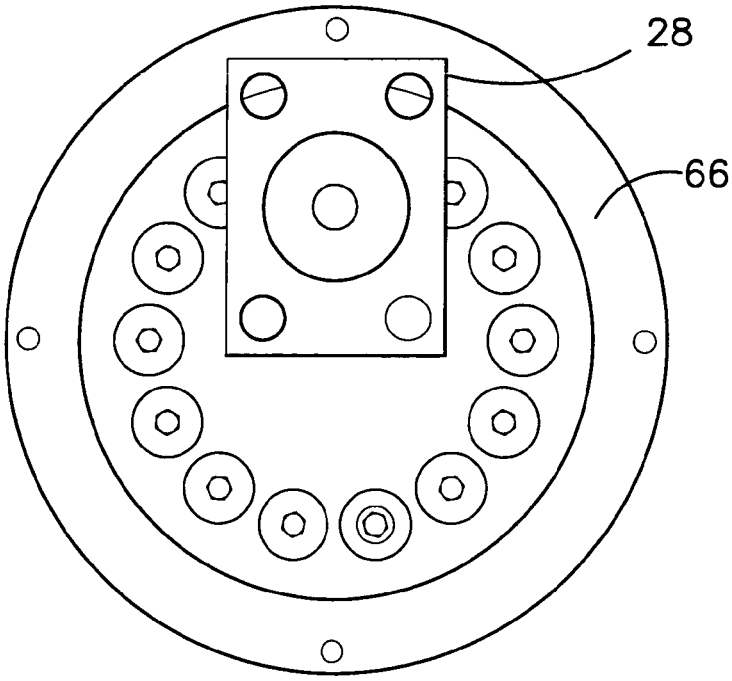
FIG. 11 is a view of the wheel of FIGS. 9 and 10 with the block attached.

In FIGS. 9-14, which show the axial drive for the sleeve, pulley bearing 50 lies between circlips 52, 54 on shaft 56 which is rotated by pulley 12. A lubrication hole 58 enters bearing 50. The opposite end of shaft 56 runs in needle bearing 60. Shaft 62 extends at 90° to shaft 56 in order to support bevel gear 18. Several tapered head screws 64 clamp thrust plate 66 to bevel gear 18. The two faces of the thrust plate are shown in FIGS. 9 and 10. The bearing is 90 mm in diameter but only the outermost 10 mm takes thrust from adjacent components on two faces. Slide block 28 is carried on pin 12 which extends at 90° from thrust bearing 66.

Figure 12:
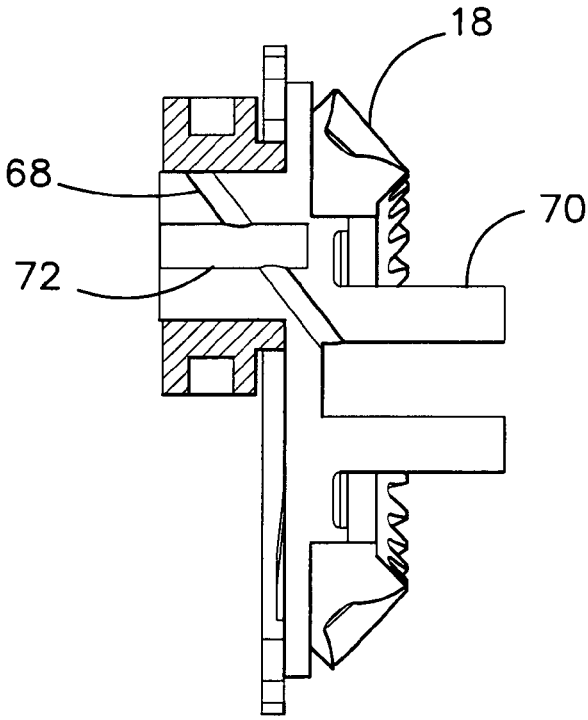
FIG. 12 is a section through FIG. 11 showing the attached bevel gear.
Figure 13:
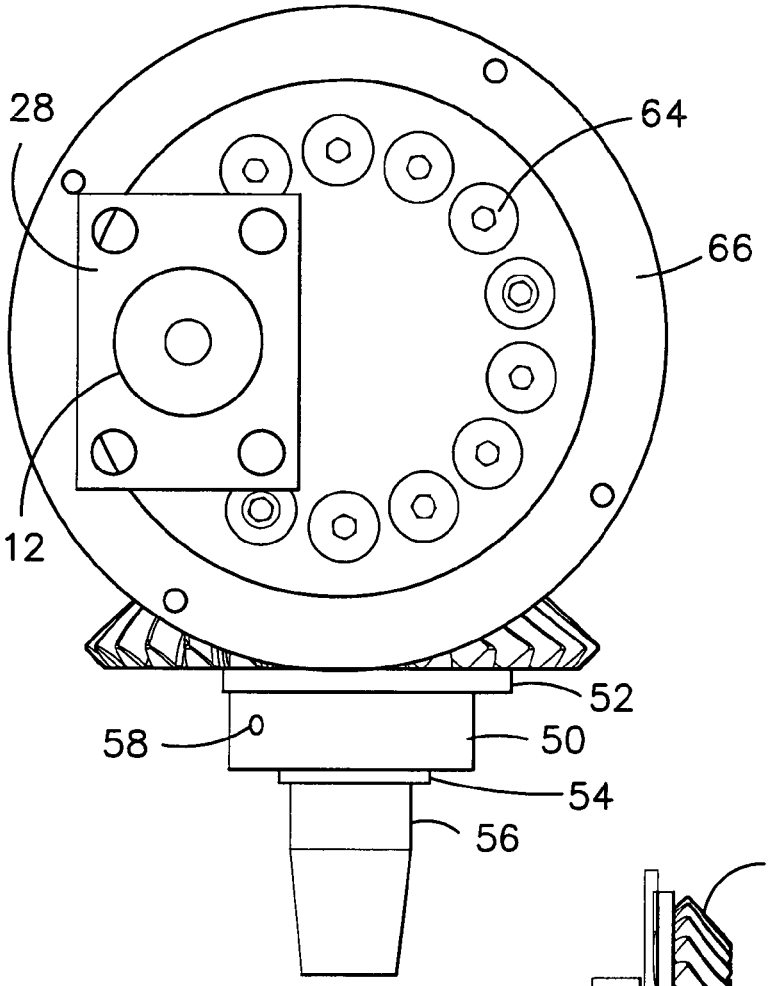
FIG. 13 is a front view of the wheel and block in a different phase from FIG. 11.
Figure 14:
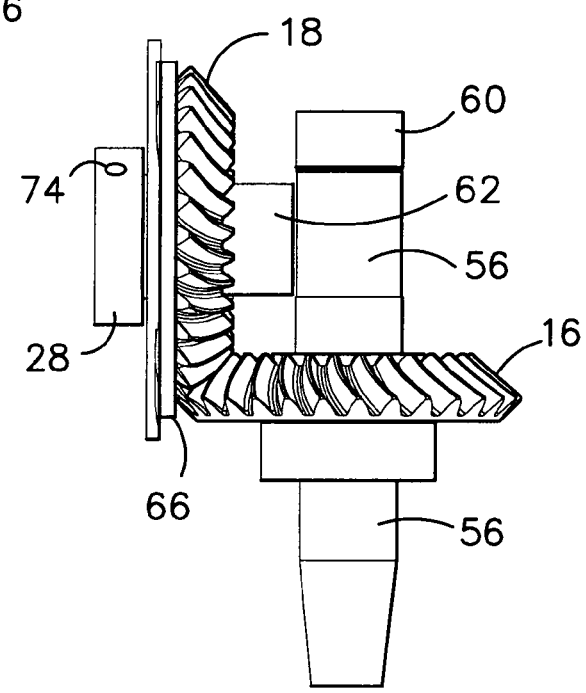
FIG. 14 is a side view showing the bevel gears and the wheel and blocks for axial sleeve motion.

FIG. 12 shows an oil passage 68 extending from the spigot 70 of the bevel gear 18 to the pin bore 72. Exit hole 74 returns oil to the sump.

Figure 15:
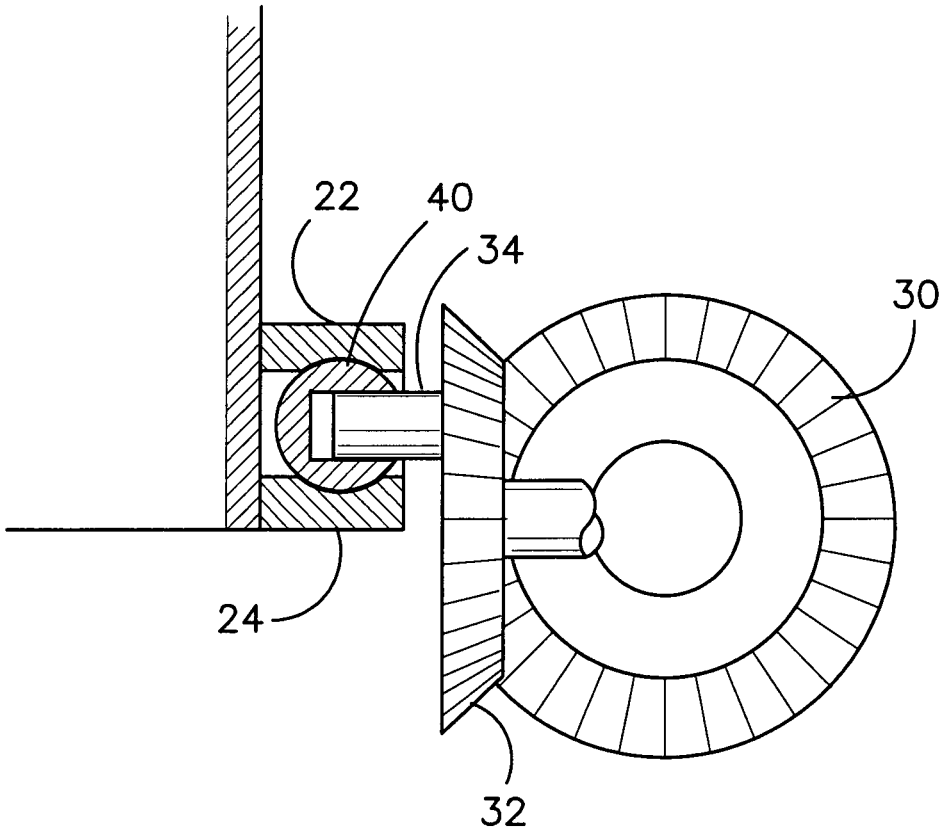
FIG. 15 is a diagrammatic plan of the drive to the sleeve for rotary sleeve motion.

In FIG. 15 the connection between pin 34 and bronze rocker 40 is shown diagrammatically.

Figure 16:
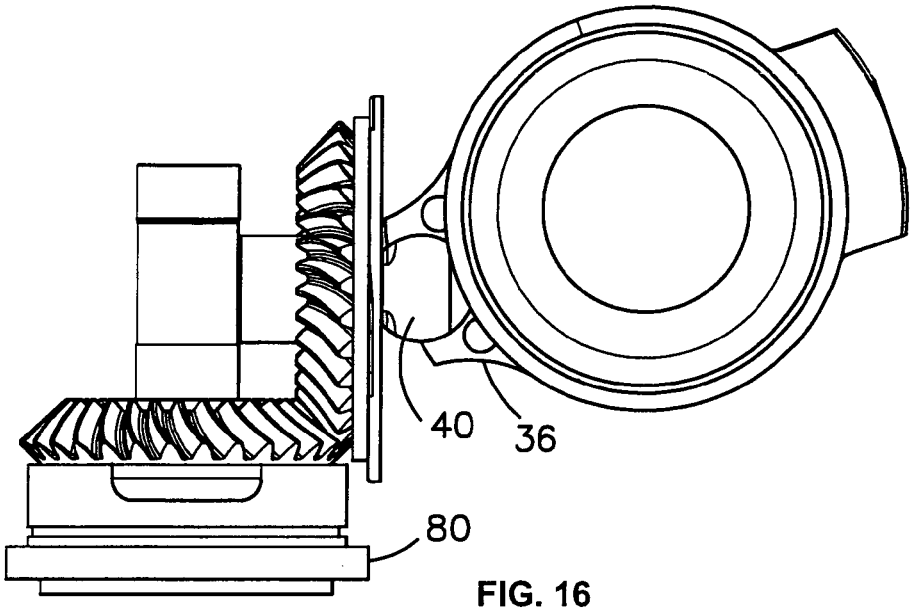
FIG. 16 is a plan view of the drive shown in FIG. 15 but as it appears in the engine.
Figure 17:
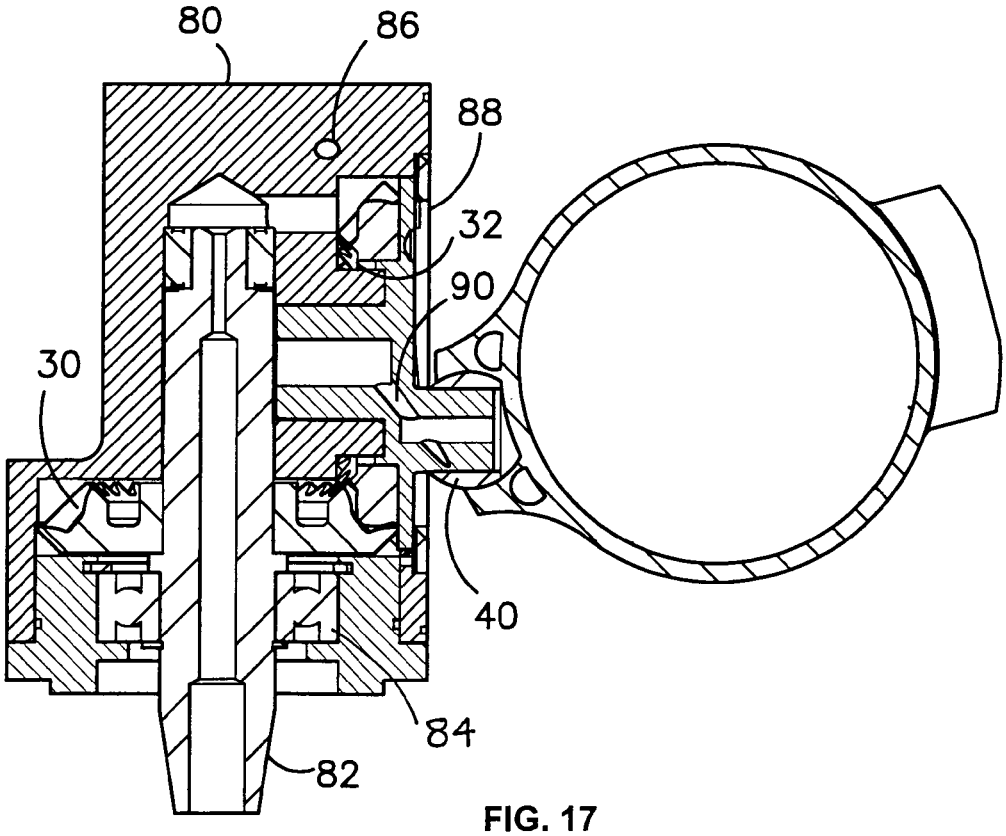
FIG. 17 is a section through FIG. 16.

In FIGS. 16 and 17, which show the rotational drive to the sleeve, housing 80 supports the same arrangement of angled shafts as in the axial sleeve drive. Shaft 82 turns in bearing 84 which abuts the annular face of a shoulder. Bevel gear 30 abuts the opposite face of the shoulder. The tapered end of shaft 82 projects from the housing and receives the end of drive pulley 10. Pin 34 is hollow and allows oil to escape from the end of the pin into rocker 40 and to lubricate split sleeve 36. Oil leaves the housing through exit hole 86. Thrust washer 88 is imprisoned between bevel gear 32 and rocker 40.

Axial Motion

Pulley 12 rotates clockwise and drives the shaft 56 which is supported between ball bearing 50 and needle bearing 60. Bearing 50 controls the axial and radial forces on this shaft. Bevel gear 16 is an interference press fit onto shaft 56. The torque can be transmitted purely on the interference but a woodroff key can be used for added drive security. The developed thrust force on bevel gear 16 is supported by the shaft shoulder.

Bevel gear 18 is secured to the shaft 62 with twelve M5 tapered head screws 64. This arrangement is well proven in the attachment of crown wheels in a motor vehicle rear wheel drive planetary differential gear centre. Alternatively the shaft and bevel gear could be manufactured in one unit.

The shaft 62 is supported on a plain journal bearing. The face 90, face 92 and the surface of the shaft 62 receive oil pressure feed. FIG. 17 shows a section view of components. These three surfaces maintain accurate shaft position against the axial inertia force of accelerating and de-accelerating the sleeve 6 and the bevel gear meshing forces.

An internal oil passage 68 also feeds the offset pin 2 and therefore the internal hole of the bronze sliding block 28. This block also has a communicating hole 90 that supplies oil to the sliding surfaces 22, 24 on bronze/sleeve interface. In this way all sliding surfaces receive oil pressure feed.

Just as there is liberal oil supply, careful design of the drive gear housing 80 with scraper edge 96, removes excess oil and returns the oil into the engine sump.

The oil pressure feed also supplies an oil spray into the meshing area of the bevel gears.

The parallel thrust faces are sufficiently long to remain in contact over 20° of the sleeve valve rotation with the bronze block 28. The maximum inertia forces occur at TDC and BDC where the parallel faces are centered on the bronze block 28.

Rotational Motion

Wheel 10 rotates clockwise and drives bevel gear 30 via shaft 70 and thereby bevel gear 32. Bevel gear 32 likewise lies adjacent to the moving sleeve valve at 180° to bevel gear 18. The axial and rotational gear sets do not necessarily need to be 180° apart.

Bevel 32 drives eccentric pin 34. Split cylindrical sleeve 36 is fixed to the outer surface of sleeve valve 6 diametrically opposite the follower 26. Eccentric pin 34 projects through a gap 38 in the split sleeve and engages bronze rocker 40. Rocker 40 has cylindrical faces equidistant from the pin 34 which mate with the internal cylindrical surface of the sleeve 36.

The shaft 82 for the rotational motion is identical to the shaft 56 of the axial motion and is supported by the identical journal oil pressure feed surfaces.

The inertia loading on the bronze rocker 40 reaches maximum value when the sleeve 6 has reached its most rotational limit. The maximum bearing area at this angle is available between split sleeve 36 and bronze circular bush 40 to keep the stresses within acceptable levels.

With this arrangement of separating the axial and rotational movement of sleeve permits a variation in port design. Such variation makes possible a narrower taller port which better supports the piston rings. This then ensures the top cylinder ring can cross the ports without any increased wear. The famous Detroit diesel V8 two stroke truck engine is testimony to this concept. Being supercharged, turbocharged and two stroke, the engine required many ports at the bottom of piston stroke to bring in the fresh air charge. Four exhaust valves were in the cylinder head. These engines travel millions of kilometres with the piston rings passing the ports on every revolution.

We have found the advantages of the above embodiment to be:

1. The port shape can be tall and narrow. Narrow ports allow a ring position high up on the piston closer to the crown.
2. The additional components are not complicated.

It is to be understood that the word "comprising" as used throughout the specification is to be interpreted in its inclusive form, ie. use of the word "comprising" does not exclude the addition of other elements.

It is to be understood that various modifications of and/or additions to the invention can be made without departing from the basic nature of the invention. These modifications and/or additions are therefore considered to fall within the scope of the invention.

The claims defining the invention are as follows:

1. A sleeve valve engine, wherein the sleeve valve which opens and closes the ports is driven by a first sleeve drive which imparts reciprocatory motion to the sleeve while a second sleeve drive imparts partial rotation to the sleeve;

wherein in the first drive a block adjacent the sleeve describes an eccentric path in order to reciprocate the sleeve and the block engages a follower projecting from the sleeve which allows the sleeve to describe an arcuate path while reciprocating.

2. A sleeve valve engine as claimed in claim 1 , wherein the follower has a thrust face at the leading end and a like thrust face at the trailing end.

3. A sleeve valve engine as claimed in claim 2, wherein the thrust faces are mutually parallel and disposed transversely to the axis of reciprocation.

4. A sleeve valve engine as claimed in claim 1, wherein the second drive comprises an axially disposed slide projecting from the sleeve with a substantially cylindrical surface interrupted by a gap, a pin which describes an eccentric path and projects into the gap and a head carried by the pin, the opposite ends of which are curved to contact the cylindrical surface, whereby the pin imparts arcuate motion to the sleeve while allowing the slide to reciprocate in cooperation with the first drive.

5. A sleeve valve engine as claimed in claim 4, wherein the pin in the second drive is eccentrically mounted on a second gear wheel rotating on the same or different axis also disposed at 90E to the cylinder axis and lying diametrically opposite the first gear wheel.

6. A sleeve valve engine as claimed in claim 1 wherein the block is eccentrically mounted on a first gear wheel which rotates on an axis disposed at 90E to the cylinder axis.

7. A sleeve valve engine as claimed in claim 6, wherein the first and second gear wheels are part of the right angle drives from the half speed valve motion gears.

* * * * *